US010309657B2

(12) United States Patent
Trice

(10) Patent No.: US 10,309,657 B2
(45) Date of Patent: Jun. 4, 2019

(54) COOKING GRATE WITH INTEGRATED VENTING

(71) Applicant: Midea Group Co., Ltd., Beijiao (CN)

(72) Inventor: Daniel J. Trice, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 58 days.

(21) Appl. No.: 15/198,815

(22) Filed: Jun. 30, 2016

(65) Prior Publication Data

US 2018/0003389 A1 Jan. 4, 2018

(51) Int. Cl.

| | |
|---|---|
| ***F24C 3/02*** | (2006.01) |
| ***F24C 3/08*** | (2006.01) |
| ***F23C 15/00*** | (2006.01) |
| ***F24C 15/32*** | (2006.01) |
| ***F24C 15/00*** | (2006.01) |

(52) U.S. Cl.

CPC ..... *F24C 3/082* (2013.01); *F24C 3/027* (2013.01); *F24C 15/006* (2013.01); *F24C 15/32* (2013.01)

(58) Field of Classification Search

CPC ..... F24C 3/082; F24C 15/32
USPC ..... 126/39 E
See application file for complete search history.

(56) References Cited

U.S. PATENT DOCUMENTS

| | | | | |
|---|---|---|---|---|
| 1,706,908 | A | 3/1929 | Westman | |
| 2,274,299 | A | 2/1942 | Mayer | |
| 4,236,503 | A | 12/1980 | Kemp | |
| 4,633,770 | A * | 1/1987 | Taylor | F24F 13/08 454/202 |
| 4,750,470 | A | 6/1988 | Beach et al. | |
| 4,850,335 | A | 7/1989 | Farnsworth et al. | |
| 4,899,028 | A * | 2/1990 | Arai | F24C 15/101 126/21 A |
| 6,098,613 | A | 8/2000 | Wiersma | |
| 8,910,622 | B2 | 12/2014 | Mishra et al. | |
| 2007/0295323 | A1 | 12/2007 | Delzell | |
| 2009/0173333 | A1 * | 7/2009 | Kwon | F24C 3/067 126/39 E |
| 2010/0300427 | A1 | 12/2010 | Kwon et al. | |
| 2011/0114077 | A1 * | 5/2011 | Mishra | F24C 15/107 126/39 R |
| 2013/0327315 | A1 * | 12/2013 | Sosso | F24C 15/20 126/39 E |

(Continued)

FOREIGN PATENT DOCUMENTS

| | | |
|---|---|---|
| CN | 2456074 Y | 10/2001 |
| CN | 102022764 | 4/2011 |

(Continued)

OTHER PUBLICATIONS

International Search Report and Written Opinion issued in PCT Application No. PCT/CN2017/087801 dated Sep. 14, 2017.

*Primary Examiner* — Steven B McAllister
*Assistant Examiner* — Allen R Schult
(74) *Attorney, Agent, or Firm* — Middleton Reutlinger

(57) ABSTRACT

A cooking grate combining the cooking surface and the venting surface for a cooking appliance. The venting surface of the cooking grate may include one or more vanes. The vanes of the venting surface may direct air towards the cooking surface. The venting surface of the cooking grate may include a depending skirt defining a cavity therein. One or more cooking grates may be used in a variety of applications.

19 Claims, 4 Drawing Sheets

(56) References Cited

U.S. PATENT DOCUMENTS

| | | | | |
|---|---|---|---|---|
| 2015/0260415 | A1* | 9/2015 | Chadwick | F24C 15/006<br>126/21 R |
| 2015/0260416 | A1 | 9/2015 | Chadwick et al. | |
| 2015/0323195 | A1 | 11/2015 | Chadwick et al. | |
| 2016/0348923 | A1* | 12/2016 | Howard | F24C 15/32 |
| 2017/0030589 | A1* | 2/2017 | Braden | F24C 15/2007 |

FOREIGN PATENT DOCUMENTS

| | | | |
|---|---|---|---|
| CN | 202494151 | U | 10/2012 |
| CN | 203442919 | U | 2/2014 |
| CN | 203571744 | U | 4/2014 |
| WO | WO2013026767 | A1 | 2/2013 |
| WO | 2015151044 | | 10/2015 |

* cited by examiner

COOKING GRATE WITH INTEGRATED VENTING

BACKGROUND

The present embodiments relate to a cooking grate with integrated venting and cooking surfaces for a cooking appliance, and particularly, but not limited to, a cooking grate for a gas range.

Various cooking grates have been proposed in the art for cooking appliances. Often, an oven vent is vented or exhausted behind the cooking grate through a vent cover or trim piece within the backguard of the oven. Therefore, the trim piece is separate from the cooking grate.

There may be several disadvantages associated with these vent covers or trim pieces that are separate from the cooking grate such as, but not limited to, undesirable additional cost of materials, labor, and time associated with manufacturing, cleaning, and/or installing the separate components.

Thus, there is a need to integrate the cooking surface and venting surface into a cooking grate.

SUMMARY

In some embodiments, a cooking appliance includes a housing having a cooktop surface and at least one air channel, at least one gas burner positioned in the cooktop surface, and at least one cooking grate having a cooking surface and a venting surface. The venting surface permits air to exit from at least one air channel of the housing and the cooking surface is adjacent at least one gas burner. The venting surface may have one or more openings therethrough to fluidly communicate with at least one air channel.

In addition, in some embodiments, the venting surface is positioned at a different elevation than the cooking surface. The venting surface may include a plurality of vanes angled upwardly and towards the cooking surface to direct air towards the cooking surface. An upper surface of at least one of the plurality of vanes may be substantially flush with an upper surface of the venting surface. The venting surface may include a depending skirt defining an outer periphery of the venting surface. The at least one cooking grate may include a plurality of feet depending from the at least one cooking grate, wherein the depending skirt of the venting surface extends less than an outermost extent of the plurality of feet. Further, the cooking surface and the venting surface are of a unitary construction, and wherein the at least one cooking grate is cast iron. The cooking surface may have one or more openings therethrough to fluidly communicate with the at least one gas burner.

In some embodiments, the cooking appliance includes a housing having a cooktop surface and at least one air channel. The at least one air channel may include at least one exit opening at the rear of the housing, at least one gas burner extending from the cooktop surface, a cooking grate having a cooking surface and a venting surface. The venting surface may include an upper surface. The venting surface has one or more vanes defining one or more openings of the venting surface. The cooking surface may include an upper surface with one or more openings. The cooking surface is disposed over the at least one gas burner and the venting surface is disposed over the exit opening of the at least one air channel.

In addition, in some embodiments, the one or more vanes are adjacent the upper surface of the venting surface. The one or more vanes are angled upwardly and towards the cooking surface to direct air towards the cooking surface.

The cooking surface and the venting surface are of a unitary construction from cast iron. The venting surface includes a depending skirt defining an outer periphery of the venting surface. A free end of the depending skirt is spaced from the cooktop surface by one or more feet of the cooking grate.

In some embodiments, the cooking appliance includes a housing having one or more gas burners and one or more air channels. One or more exit openings of the one or more air channels is positioned behind the one or more gas burners adjacent a back of the housing. At least one cooking grate has an upper surface extending across a cooking surface and a venting surface. The venting surface may include a depending skirt adjacent an outer periphery of the venting surface defining a cavity in fluid communication with the one or more exit openings of the housing and the upper surface of the at least one cooking grate. The at least one cooking grate allows heat to flow upward from the one or more gas burners and air to vent from the one or more exit openings of the one or more air channels.

In addition, in some embodiments, the venting surface includes one or more vanes adjacent the upper surface of the venting surface. An upper surface of at least one of the one or more vanes is substantially flush with the upper surface of the venting surface. The upper surface of the venting surface is spaced upwardly from the upper surface of the cooking surface. The one or more air channels of the housing are for exhausting air from a cooking compartment within the housing or for a cooling air stream. An outer periphery of the at least one cooking grate includes at least a portion of the depending skirt.

These and other advantages and features, which characterize the embodiments, are set forth in the claims annexed hereto and forming a further part hereof. However, for a better understanding of the embodiments, and of the advantages and objectives attained through its use, reference should be made to the Drawings, and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
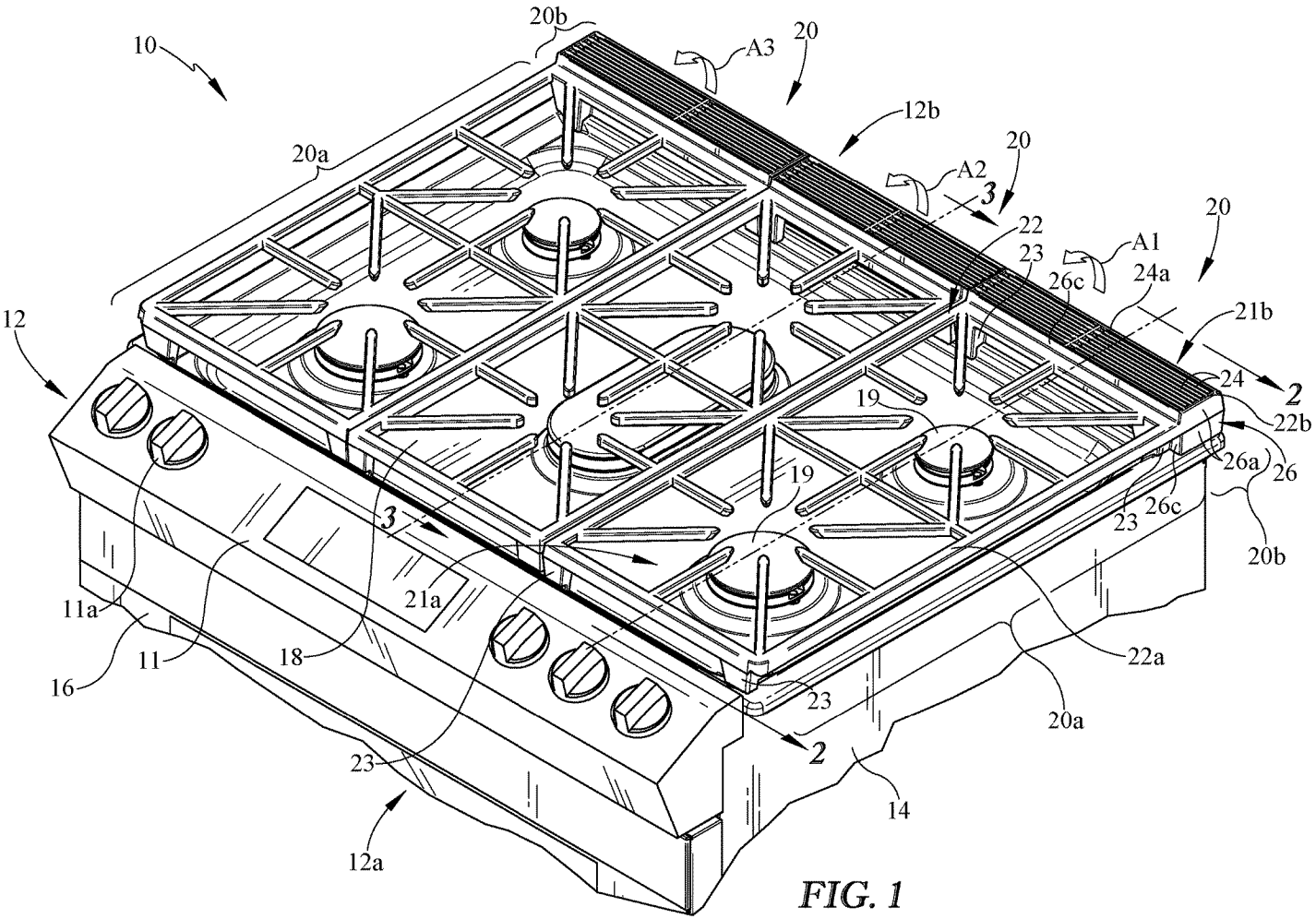
FIG. 1 is a perspective view of one embodiment of the cooking grate with integrated venting in an installed position with bottom portions of the oven range broken away.

As shown in the Figures, a home cooking appliance 10, such as but not limited to a slide-in cooking range, has a housing 12 and a cooking compartment 14, such as a baking oven, convection oven, steam oven, warming drawer and the like, in the housing 12 and accessible through a door or drawer 16 in the front 12*a* of the housing 12. In the embodiment shown, the appliance 10 is a gas range. The appliance 10 includes a cooktop surface 18 on a top of the housing 12. The cooktop surface 18 can include one or more cooking grates 20 thereon, with at least one cooking grate 20 having a cooking surface or section 20*a* and a venting surface or section 20*b*. The cooking surface 20*a* of the cooking grate 20 may include one or more openings 21*a* in fluid communication with one or more gas burners 19. The cooking surface 20*a* of the cooking grate 20 may support a cooking vessel or cookware (not shown) over one or more gas burners 19. The venting surface 20*b* of the cooking grate 20 may include one or more openings 21*b* in fluid communication with, or permitting air to exit, one or more air channels or passageways 15 of the housing 12. The appliance 10 includes a control panel 11 having a plurality of control knobs or controls 11*a* for controlling the gas burners 19 and/or cooking compartment 14.

As shown in FIGS. 1-4, the cooking grate 20 integrates or combines both the cooking surface 20*a* and the venting surface 20*b* into a unitary component or structure. The integrated cooking grate 20 may be of a unitary construction, such as but not limited to cast iron. It is to be understood that the unitary construction may comprise a variety of compositions, such as one or more materials. Because the structure of the cooking grate 20 is integrated, the upper surface 22 of the cooking grate 20 may extend across both the cooking surface 20*a* and venting surface 20*b* to provide a substantially continuous appearance across the top or portion of the housing 12, or more specifically from the front 12*a* to the back 12*b* of the housing 12. The upper surface 22 of the cooking grate 20 may include an upper surface 22*a* of the cooking surface 20*a* and an upper surface 22*b* of the venting surface 20*b*. Although one embodiment of the cooking surface 20*a* and venting surface 20*b*, upper surfaces 22*a* and 22*b*, and openings 21*a* and 21*b* is illustrated in the Figures, one or more embodiments may be of a variety of patterns, shapes, sizes, and quantities and still be within the scope of the teachings herein.

The cooking appliance 10 may include one or more air channels 15 allowing air to circulate through, into, and/or out of the housing 12 or portions thereof. For example one or more air channels 15 may, for example, provide flow for a cooling air stream from one or more areas of the housing 12 and/or oven compartment air stream from the cooking compartment 14. One embodiment shown in FIG. 2 of channel 15 includes one or more exit openings 15*a* in fluid communication with the housing area below the cooktop surface 18 and above the cooking compartment 14 thereby removing heat from the housing 12 and/or resulting in a cooling air stream. It should be understood that the one or more channels 15 and openings 15*a* may define a variety of flow paths with the cooking appliance 10 and be a variety of sizes, shapes, construction, and quantities and still be within the scope of the teachings herein.

As shown in FIG. 1, the appliance 10 may include one or more cooking grates 20 to overlay a variety of surface areas of the housing 12 or cooktop surface 18. Although a plurality of cooking grates 20 is shown atop the cooktop surface 18, a single grate 20 may be used in some applications. When assembled, the cooking grates 20 may be positioned such that the venting surfaces 20*b* and/or the cooking surfaces 20*a* are adjacent to each other as shown. Further although each cooking grate 20 is shown as similar in construction, it is understood that one or more of the cooking grates 20 may include one or more structural differences from each other. For example, if a cooking grate 20 includes the venting surface 20*b* it may be of a different pattern from one or more of the other cooking grates 20. Further, it should be understood that an embodiment of the cooking surface 20*a* or portions thereof may include an integrated griddle pattern (not shown) with the venting surface 20*b* in one or more embodiments. For example, the embodiment of the cooking grate, or more specifically the center cooking grate, may include a cooking surface 20*a* with a griddle pattern or substantially planar upper surface in the front of the cooking grate and the venting surface 20*b* in the back of the cooking grate. The griddle pattern or portions of the cooking surface 20*a* may not have openings therein. As is shown in the embodiments, the cooking grate 20 includes both the cooking surface 20*a* and the venting surface 20*b* such that the front of the cooking grate may include the cooking surface 20*a* and the back may include the venting surface 20*b*. As is shown, the front of the cooking grate that includes the cooking surface 20*a* covers, or is adjacent to, a portion of the cooktop surface 18 having one or more gas burners 19 extending therefrom and is in fluid communication with the gas burners 19. The back of the cooking grate 20 that includes the venting surface 20*b* is disposed over, covers, or is adjacent to and in fluid communication with, one or more exit openings 15*a* of one or more air channels 15 of the housing 12. Therefore, the cooking grate 20 allows heat to flow upward from the gas burner 19 and air to vent from the exit opening.

Figure 2:
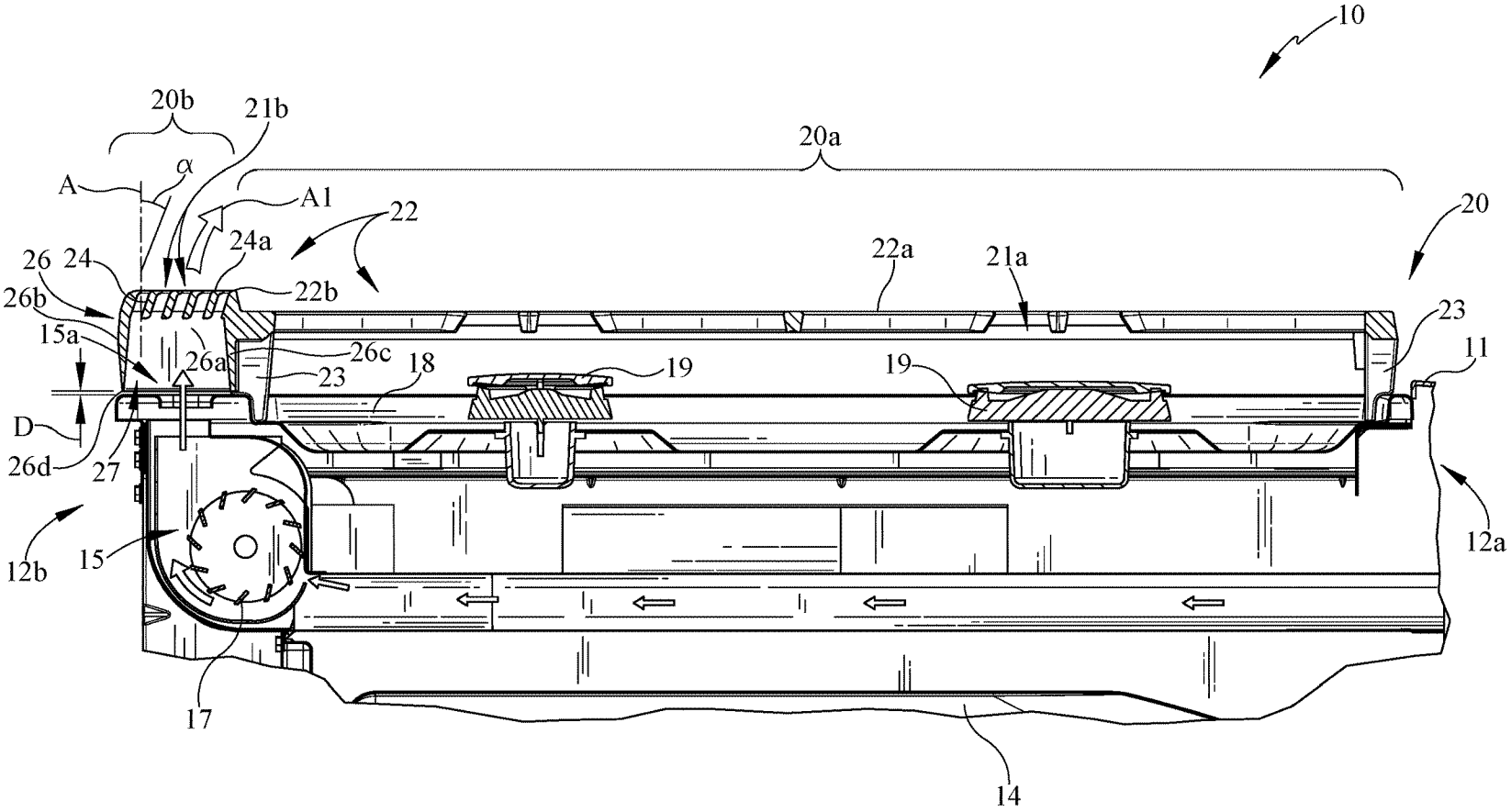
FIG. 2 is a cross sectional view of the embodiment of FIG. 1 taken along line 2-2.
Figure 3:
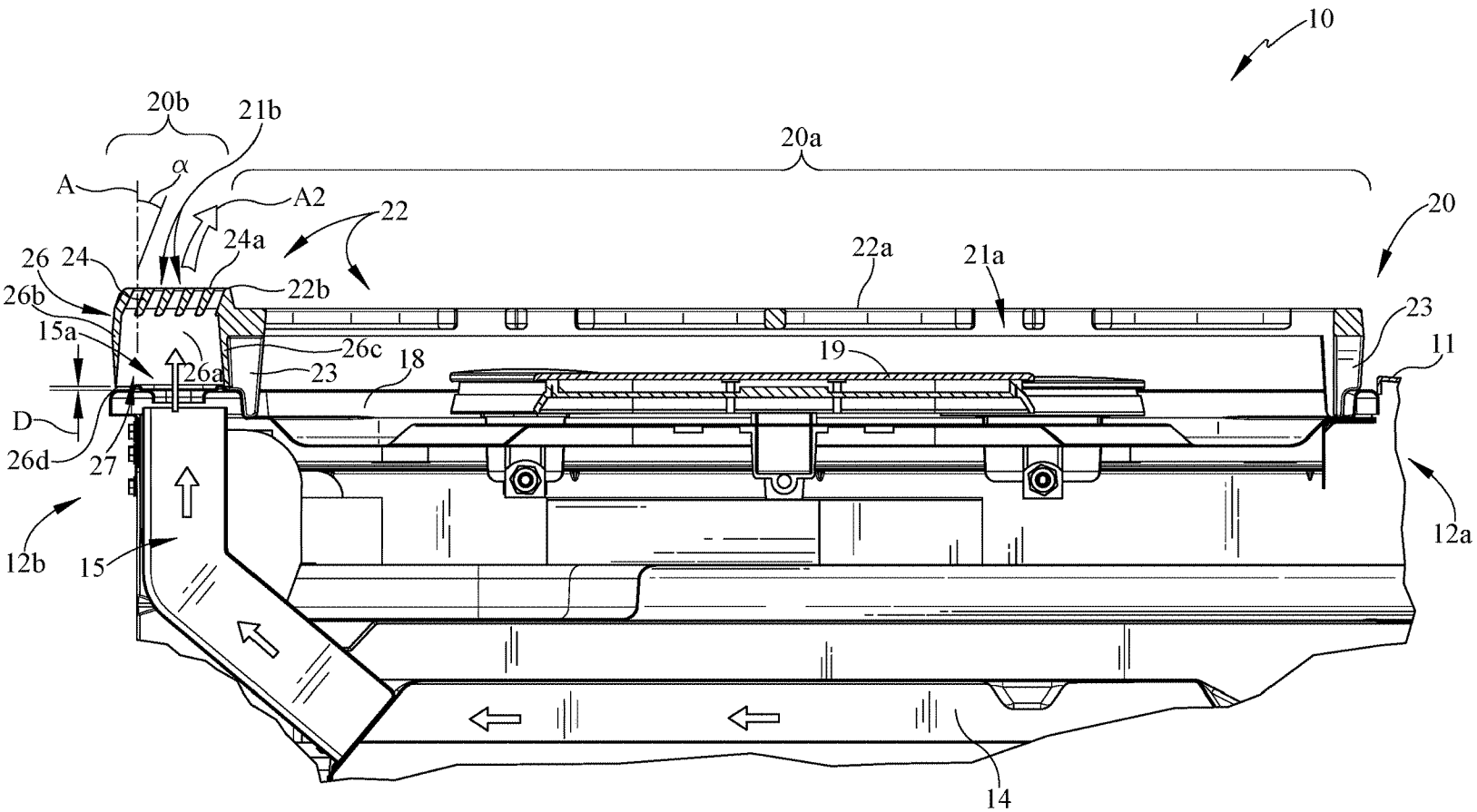
FIG. 3 is a cross sectional view of the embodiment of FIG. 1 taken along line 3-3.

The venting surfaces 20*b* of the cooking grate 20 may be in fluid communication with one or more air channels 15 of the housing 12. As illustrated in FIG. 1, three arrows indicate air flows directed upwardly and away from their respective cooking grate 20, and/or back wall (not shown), through each one of the cooking grate's venting surface 20*b*. The airflow A1, as shown in FIGS. 1 and 2, is a cooling air stream exiting the venting surface 20*b*. The air stream A1 may circulate or pass through the housing 12 or a variety of ducts, cavities, and air channels 15 from various areas of the appliance 10, inside and/or outside. For example, this cooling air stream may reduce the temperature of the door 16, cooktop surface 18 region, controls compartment, and/or other portions of the housing 12 before exiting one or more venting surfaces 20*b* of one or more cooking grates 20. A fan 17 may also force the air flow through the one or more channels 15 before exhausting through one or more exit openings 15*a*. In one embodiment as shown in FIGS. 1 and 3, the center cooking grate 20 may exhaust air or airflow A2 through one or more air channels 15 from the cooking compartment 14 alone or in combination with another grate venting surface 20*b*. The oven air stream or exhausting airflow A2 from the cooking compartment 14 may pass through a variety of ducts, cavities, and air channels 15 of the housing 12 before exiting one or more venting surfaces 20*b* of one or more cooking grates 20. The cooking compartment 14 air may exit by convection through the one or more channels 15 and exhaust from the one or more exit openings 15*a* and subsequently through the one or more openings 21*b* of the grate's venting surface 20*b*. The airflow A3, as shown in FIG. 1, may be a cooling air stream circulating or passing through one or more ducts, cavities, or air channels (not shown) through the appliance 10 or housing 12. The air stream A3 may pass through the housing 12 or a variety of ducts, cavities, and air channels (not shown) from various areas of the appliance 10, inside and/or outside. For example, this cooling air stream may reduce the temperature of the housing 12 side and back walls, cooktop surface 18 region, controls compartment, and/or other portions of the housing 12 before exiting one or more venting surfaces 20*b* of one or more cooking grates 20. As such the venting surface 20*b* of the cooking grate 20 may be directed in a variety of directions although shown as upwardly and away from the cooking grate 20 and towards the cooking surface 20*a* of the cooking grate 20. Although not shown, it should be understood that the venting surface 20*b* of the cooking grate 20 may be positioned without being adjacent to an air channel 15 or exit opening 15*a*, or stated alternatively that it does not exhaust or is not in fluid communication with an air channel 15. For example, the venting surface 20*b* of a cooking grate 20 may be cosmetic, alone or in combination, with one or more other cooking grates. Further, the air flow through one or more air channels 15 may, but need not necessarily include, forced air.

The outer periphery of the cooking grate 20 includes both the cooking surface 20*a* and the venting surface 20*b* such that the front of the cooking grate may include the cooking surface 20*a* and the back may include the venting surface 20*b*. Although the embodiment shows the relative positons of the cooking surface 20*a* and venting surface 20*b* to each other, there may be other arrangements. As is shown in one embodiment, one or more feet 23 engage one or more surfaces of the appliance 10 or housing 12 to space the cooking grate 20, or portions thereof, from the cooktop surface 18 or other portions of the housing 12. One or more of the feet 23 may depend from the outer periphery of the cooking grate 20 and engage the cooktop surface 18, although the feet 23 may extend from a variety of structures of the cooking grate 20. For instance, the feet may extend from one or both of the venting surface 20*b* and cooking surface 20*a* or adjacent therebetween. As is shown, one pair of feet 23 may be adjacent the control panel 11, or front of the housing 12, and another pair of feet 23 may be adjacent the exit openings 15*a* of the air channels 15, or back 12*b* of the housing 12. The feet 23 may engage the cooktop surface 18 or other portions of the housing 12. As is shown, the rear feet 23 may be spaced from the outer periphery or back of the cooking grate 20 and may be adjacent or between the cooking surface 20*a* and venting surface 20*b*. Spacing one or more feet 23 from the distal end or back of the cooking grate 20 that contains the venting surface 20*b* may reduce the contact of the venting surface 20*b* or other portions of the cooking grate 20 with the housing 12 or cooktop surface 18 and reduce possible abrasions.

Figure 4:
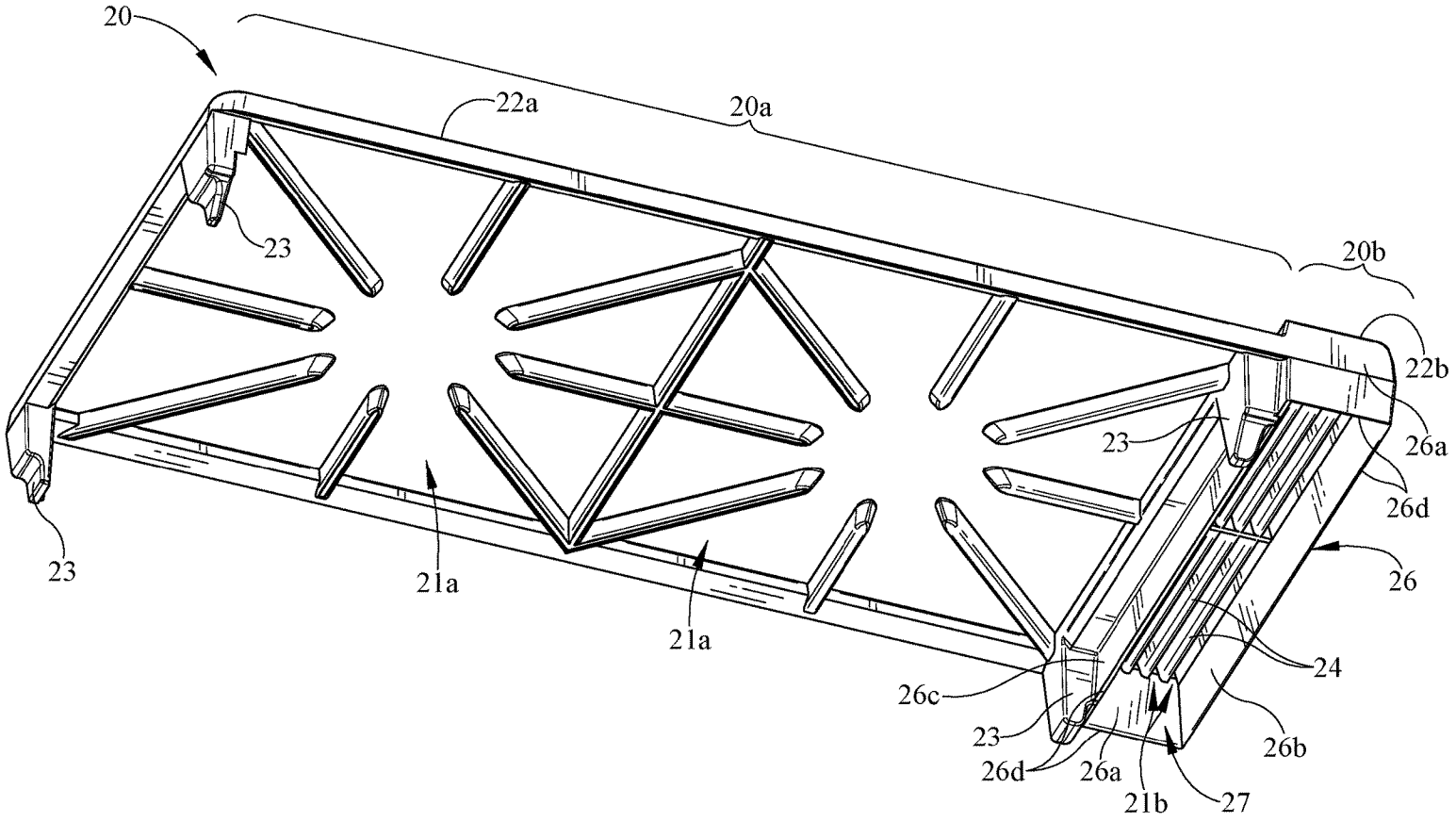
FIG. 4 is bottom perspective view of the cooking grate embodiment shown in FIG. 1.

As is shown in FIGS. 1-4, the upper surface 22 of the cooking grate 20 extends across the cooking surface 20*a* and the venting surface 20*b*. In one embodiment, the upper surface 22 of the cooking grate 20 may be interrupted by one or more openings 21*a* within the cooking surface 20*a* and one or more openings 21*b* of the venting surface 20*b*. In another embodiment, at least a portion of the cooking surface 20*a* may be a griddle (not shown). Although, the upper surface 22*a* of the cooking surface 20*a* is shown as a different or lower elevation than the upper surface 22*b* of the venting surface 20*b*, each upper surface 22*a* and 22*b* may be, if desired, substantially the same elevation from the housing 12 or portions thereof. Further, the upper surface 22*a* and 22*b* of the cooking surface 20*a* and venting surface 20*b*, respectively, are substantially parallel to each other. Alternatively, the upper surface 22*b* or portions of the venting surface 20*b* may be angled relative to the upper surface 22*a* of the cooking surface 20*a*. The venting surface 20*b* of the cooking grate 20 in the embodiment shown may alternatively be described as stepped or raised from the cooking surface 20*a* of the cooking grate 20. Although the one or more openings 21*b* of the venting surface 20*b* are shown in FIGS. 1 and 4 as discontinuous across the width of the cooking grate 20, the openings 21*b* may be continuous or a variety of positions, shapes, and sizes. Further, the upper surface 22*b* of the venting surface 20*b* may include one or more of vanes 24 defining the one or more openings 21*b* therein. The upper surfaces 24*a* of the vanes 24 may be substantially flush with the remaining portions of the upper surface 22*b* of the venting surface 20*b* as is shown in FIGS. 1-3. Alternatively, the vane upper surface 24*a* could be above and/or below the venting surface's upper surface 22*b* as, for example, recessed within the upper surface 22*b* or outer periphery of the venting surface 20*b*. In the embodiment shown, the one or more vanes 24 are angled upwardly and towards the cooking surface 20*a* to direct air towards the cooking surface 20*a* or front 12*a* of the housing 12. The angle $\alpha$ may be in the range of approximately 5 to 85 degrees, but preferably approximately 10 to 80 degrees from the vertical axis A. Further, one or more vanes 24 may be positioned at a variety of elevations within a skirt 26 of the venting surface 20*b*.

As shown in the Figures, the venting surface 20*b* of the cooking grate 20 may include a depending skirt 26 about its outer periphery or portions thereof. The skirt 26 may coincide with one or more portions of the outer periphery of the cooking grate 20 as is shown. For example, portions of one or more of the lateral peripheral walls 26*a* and rearward peripheral wall 26*b* depend from adjacent one or more outer peripheral portions of the cooking grate 20, more specifically the back and lateral sides or portions of the cooking grate 20. The forward peripheral wall 26*c* may be adjacent the cooking surface 20*a* of the cooking grate 20. The skirt 26 or portions thereof may also engage a length of the depending feet 23 as is shown, or alternatively be disengaged therefrom. The skirt 26 of the venting surface 20*b* defines a cavity or passageway 27 or portions thereof. The cavity 27 of the venting surface 20*b* is in fluid communication between the one or more openings 21*b* and the exit openings 15*a* of the air channel 15. Within the skirt 26, one or more vanes 24 may be used to direct the flow of air in a variety of directions from the venting surface 20*b*. Portions of the skirt 26 may depend a variety of distances from upper surface 22*b* of the venting surface 20*b*. For example one or more of the front or forward peripheral wall 26*c*, rearward peripheral wall 26*b*, and lateral peripheral walls 26*a* may downwardly extend less than the distal end or outermost extent of the feet 23 or may be spaced from the cooktop surface 18. The spacing of the free end 26*d* of the skirt 26 away from the cooktop surface 18 or other portions of the housing 12 may produce a gap or distance D. This distance D may reduce abrasion to the cooktop surface 18. It is understood that the skirt 26 may abut the cooktop surface 18. Further shown, one or more of the walls of the skirt 26 may taper inwardly towards the upper surface 22*b* of the venting surface 20*b* thereby by narrowing the cavity 27 in the direction from the cooktop surface 18 towards the upper surface 22 of the cooking grate 20 or upper surface 22*b* of the venting surface 20*b*. For example, at least the skirt forward peripheral wall 26*c* and rearward peripheral wall 26*b* are shown in FIGS. 2-4 to taper the cavity 27. It should also be understood that one or more of the lateral peripheral walls 26*a* alone or in combination with skirt walls 26*c* and/or 26*b* may taper cavity 27. Although the skirt free ends 26*d* define the open end of a downward facing opening, it should be understood that the skirt walls may define one or more openings within the skirt 26 itself or in combination with other structure, such as but not limited to, the cooktop surface 18, in a variety of positions and directions to channel air into and/or out of the venting surface 20*b*.

The cooking grate 20 may be of a unitary construction combining the cooking surface 20*a* and venting surface 20*b* into a single piece. For example, the cooking grate 20 may be formed from cast iron by a sand casting process that is commonly known in the art of manufacturing stove-top cooking grates. A sand core may be used to manufacture the venting surface 20*b* of the back section of the cooking grate 20. One advantage of the cooking grate 20 embodiment in use may be in manufacturing, installation, and/or cleaning of the cooking grate 20. Because the cooking grate 20 includes both a cooking surface 20*a* and a venting surface 20*b* as a single piece, the unitary component may be handled together instead of separate. Therefore, the time, labor, and cost to manufacture and install may be reduced. Further when cleaning the cooking grate 20, the end user may temporarily remove the cooking grate to clean both the cooking surface 20*a* and the venting surface 20*b*, as opposed to handling separately components to clean. As such in use, one or more plugs or covers may be used (not shown) to overlay the one or more exit openings 15*a* at the back 12*b* of the housing 12 when the cooking grate 20 is removed for cleaning.

Although the integrated cooking grate 20 is shown in detail in the drawings, it is merely representative of one embodiment, and it is to be understood that there are a variety of shapes, sizes, orientations, constructions, and quantities which may be used and still be within the scope of the teachings herein.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A cooking appliance comprising:

a housing having a cooktop surface defining at least one air channel therethrough, wherein said at least one air channel includes one or more exit openings through said cooktop surface;

at least one gas burner positioned in said cooktop surface;

at least one cooking grate having a cooking surface and a venting surface and combined as a unitary structure, wherein both said cooking surface and said venting surface of said at least one cooking grate is disposed over said cooktop surface of said housing, said venting surface permitting air to exit from said one or more exit openings of said cooktop surface through said at least one air channel of said housing, wherein said cooking surface is adjacent said at least one gas burner and said venting surface has one or more openings therethrough to fluidly communicate with said at least one air channel; and wherein said venting surface includes an outer peripheral skirt spaced upwardly from said cooktop surface and surrounding a plurality of vanes defining said one or more openings therethrough, wherein said outer peripheral skirt is continuous and surrounds said one or more exit openings of said at least one air channel to define a downstream passageway in fluid communication from said one or more exit openings of said at least one air channel to said one or more openings through said venting surface and wherein said at least one air channel exhausts airflow from inside said housing though said one or more openings of said venting surface.

2. The cooking appliance of claim 1 wherein said venting surface is positioned at a different elevation than said cooking surface.

3. The cooking appliance of claim 1 wherein said venting surface includes said plurality of vanes tilted at an angle above a horizontal plane and towards said cooking surface to direct air towards said cooking surface.

4. The cooking appliance of claim 3 wherein an upper surface of at least one of said plurality of vanes is flush with an upper surface of said venting surface.

5. The cooking appliance of claim 1 wherein said at least one cooking grate includes a plurality of feet depending from said at least one cooking grate, wherein said depending skirt of said venting surface extends less than an outermost extent of said plurality of feet.

6. The cooking appliance of claim 1 wherein said cooking surface and said venting surface are made at least partially of cast iron.

7. The cooking appliance of claim 1 wherein said cooking surface has one or more openings therethrough to fluidly communicate with said at least one gas burner.

8. A cooking appliance comprising:

a housing having a cooktop surface defining at least one air channel therethough, wherein said at least one air channel includes at least one exit opening through said cooktop surface at the rear of said housing;

at least one gas burner extending from said cooktop surface;

a cooking grate having a cooking surface and a venting surface and combined as a unitary structure, wherein said venting surface includes an upper surface, said venting surface having one or more vanes defining one or more openings of said venting surface, wherein said cooking surface includes an upper surface with one or more openings;

said cooking surface is disposed over said at least one gas burner and said venting surface is disposed over said exit opening of said cooktop surface defining said at least one air channel, wherein said at least one air channel exhausts airflow from inside said housing through said one or more openings of said venting surface;

wherein said venting surface includes an outer periphery frame, wherein said outer periphery frame is continuous and surrounds said at least one exit opening of said cooktop surface defining said at least one air channel to define a downstream passageway in fluid communication from said at least one exit opening of said cooktop surface defining said at least one air channel to said one or more openings through said venting surface; and a free end of said outer periphery frame surrounding said at least one exit opening of said cooktop surface is spaced from said cooktop surface by one or more feet of said cooking grate.

9. The cooking appliance of claim 8 wherein said one or more vanes are adjacent said upper surface of said venting surface.

10. The cooking appliance of claim 9 wherein said one or more vanes are tilted at an angle above a horizontal plane and towards said cooking surface to direct air towards said cooking surface.

11. The cooking appliance of claim 8 wherein said cooking surface and said venting surface are made of at least partially of cast iron.

12. A cooking appliance comprising:

a housing having one or more gas burners and one or more air channels, wherein said one or more gas burners and one or more exit openings of said one or more air channels extends through a cooktop surface, wherein said one or more exit openings of said one or more air channels is positioned behind said one or more gas burners adjacent a back of said housing cooktop surface;

at least one cooking grate having an upper surface extending across a cooking surface and a venting surface combined as a unitary structure, wherein an outer periphery of said venting surface rearwardly extends from an outer periphery of said cooking surface, wherein said venting surface includes a depending skirt adjacent and continuous about said outer periphery of said venting surface and a plurality of vanes to define a cavity in fluid communication with said one or more exit openings of said housing and said upper surface of said at least one cooking grate outside said cooking surface;

wherein said depending skirt of said venting surface is spaced from and above said cooktop surface defining said one or more exit openings; and wherein said at least one cooking grate allows heat to flow upward from said one or more gas burners and allows airflow to vent exhaust from said one or more exit openings of said one or more air channels from inside said housing through said plurality of vanes of said venting surface.

13. The cooking appliance of claim 12 wherein an upper surface of at least one of said one or more vanes is flush with said upper surface of said venting surface.

14. The cooking appliance of claim 12 wherein said upper surface of said venting surface is spaced upwardly from said upper surface of said cooking surface.

15. The cooking appliance of claim 12 wherein said one or more air channels of said housing are for exhausting air from a cooking compartment within said housing or for a cooling air stream.

16. The cooking appliance of claim 12 wherein an outer periphery of said at least one cooking grate includes at least a portion of said depending skirt.

17. The cooking appliance of claim 1 wherein said cooking grate is formed by fixedly joining said cooking surface and said venting surface.

18. The cooking appliance of claim 1 wherein said cooking surface and said venting surface of said cooking grate have a fixed orientation relative to each other.

19. The cooking appliance of claim 1 wherein said cooking surface and said venting surface are formed together during manufacture.

* * * * *